US007862485B2

(12) United States Patent
Luigi

(10) Patent No.: US 7,862,485 B2
(45) Date of Patent: Jan. 4, 2011

(54) SPARRING PARTNER

(76) Inventor: Giancarlos Luigi, Avenida Pedro Albizu Campos #62, Sutie 2, Aguadilla, PR (US) 00603

( * ) Notice: Subject to any disclaimer, the term of this patent is extended or adjusted under 35 U.S.C. 154(b) by 0 days.

(21) Appl. No.: 12/351,887

(22) Filed: Jan. 12, 2009

(65) Prior Publication Data

US 2010/0179031 A1 Jul. 15, 2010

(51) Int. Cl.
*A63B 69/30* (2006.01)
*A63B 69/34* (2006.01)

(52) U.S. Cl. ..... 482/89; 482/83

(58) Field of Classification Search ..... 482/83–90; 273/440.1; 473/422, 423, 438, 442; D21/787, D21/798

See application file for complete search history.

(56) References Cited

U.S. PATENT DOCUMENTS 4,434,980 A * 3/1984 Babineaux ..... 482/86
4,564,192 A * 1/1986 Lebowitz ..... 482/87
5,352,170 A * 10/1994 Condo et al. ..... 482/83
5,389,057 A * 2/1995 Zagata, Jr. ..... 482/83
5,458,552 A * 10/1995 Mara ..... 482/90
5,899,835 A * 5/1999 Puranda ..... 482/90
5,941,801 A * 8/1999 D'Alto ..... 482/90
6,375,600 B1 * 4/2002 Mallette ..... 482/86
6,461,281 B2 * 10/2002 Bouvier ..... 482/86
6,743,157 B2 * 6/2004 Hackaday ..... 482/83
6,893,384 B2 * 5/2005 Triani ..... 482/83
7,329,210 B1 * 2/2008 Marano ..... 482/83
7,488,276 B2 * 2/2009 Luigi ..... 482/89
2002/0193211 A1 * 12/2002 Kao ..... 482/83
2003/0073548 A1 * 4/2003 Haselrig ..... 482/83

* cited by examiner

*Primary Examiner*—Loan Thanh
*Assistant Examiner*—Allana Lewin

(57) ABSTRACT

A boxing device that fights back in response to an attackers blows to simulate a boxing match comprises a boxing bag, a pair of padded arms each having a boxing glove at its end, and a pair of reel type pieces wherein each of said reel type piece works as an axis holding each a padded arm that rotates around the piece in response to an impact applied to the boxing bag.

5 Claims, 9 Drawing Sheets

SPARRING PARTNER

RELATED APPLICATIONS

This application is related to U.S. Pat. No. 7,488,276 issued on Feb. 10, 2009.

STATEMENT REGARDING FEDERALLY SPONSORED RESEARCH AND DEVELOPMENT

N/A

BACKGROUND OF THE INVENTION

1. Field of the Invention

This invention relates generally to boxing devices and more particularly to a device that fights back and serves as a sparring partner by swinging its own arms to its attackers.

2. Discussion of the Background

Boxing is not only a sport, but an aerobic exercise too. There are various devices in the prior art that teach or train a person in certain specific aspects of boxing. Some devices in the prior art disclose arm-like structures which may swing at an attacker in response to a blow. For instance U.S. Pat. No. 4,434,980 to Babineaux discloses a device that fights back comprising a boxing bag and a pair of arms. However, Babineaux invention does not simulate actual fighting conditions as the arms swing forward in predictable motions.

Therefore, it can be appreciated that there exists a continuing need for a new and improved training device in the prior art that can train all aspects of boxing and kickboxing in one training session. In this regard, the present invention substantially fulfills this need.

SUMMARY OF THE INVENTION

The object of the present invention is to provide a device that trains the offensive and defensive movements for self-defense.

Another object of the present invention is to provide a device that improves the user's offensive and defensive reflexes.

Another object of the present invention is to provide a detachable heavy bag device for training the offensive and defensive movements for self-defense.

Another object of the present invention is to provide a device that can be attached to any pre-existing training bag for advance self-defense training.

It is still a further object of the present invention to provide a device that gives the user a cardiovascular exercise.

Another object of the present invention is to provide a device that improves muscular strength of the upper and lower body.

A further object of this invention is that it is easy and safe to use.

Still a further object of this invention is that it can be used by both left and right handed boxers.

Another object of this invention is to give the user the sensation of being in a boxing match without the risk of injury.

The sparring partner itself, both as to its construction and its mode of operation will be best understood, and additional objects and advantages thereof will become apparent, by the following detailed description of a preferred embodiment taken in conjunction with the accompanying drawings.

When the word "invention" is used in this specification, the word "invention" includes "inventions", that is, the plural of "invention". By stating "invention", the Applicant does not in any way admit that the present application does not include more than one patentably and non-obviously distinct invention and Applicant maintains that the present application may include more than one patentably and non-obviously distinct invention. The Applicant hereby asserts, that the disclosure of the present application may include more than one invention, and, in the event that there is more than one invention, that these inventions may be patentable and non-obvious one with respect to the other.

Further, the purpose of the accompanying abstract is to enable the U.S. Patent and Trademark Office and the public generally, and especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

DESCRIPTION OF THE PREFERRED EMBODIMENT

Figure 1A:
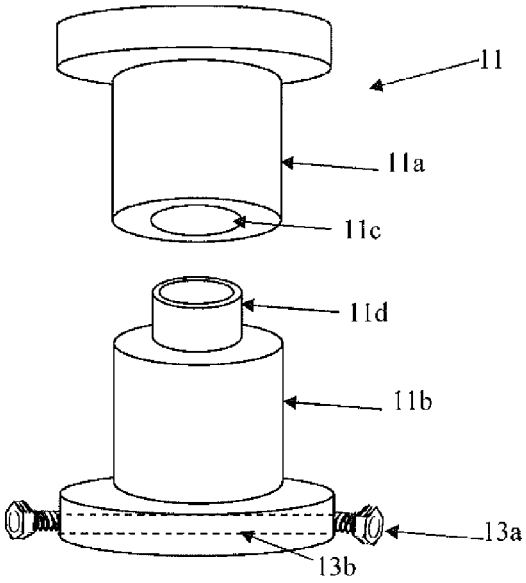
FIGS. 1*a*-1*h* are views of the several components of one the first embodiment.
Figure 1B:
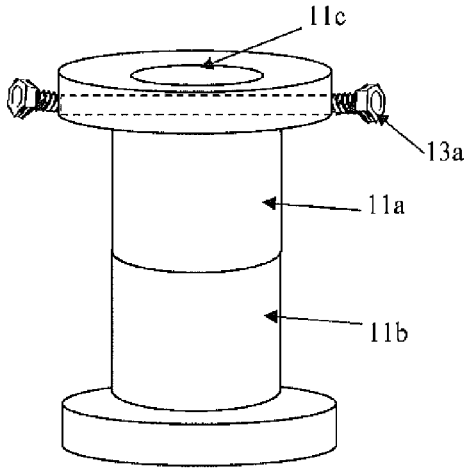
Figure 1C:
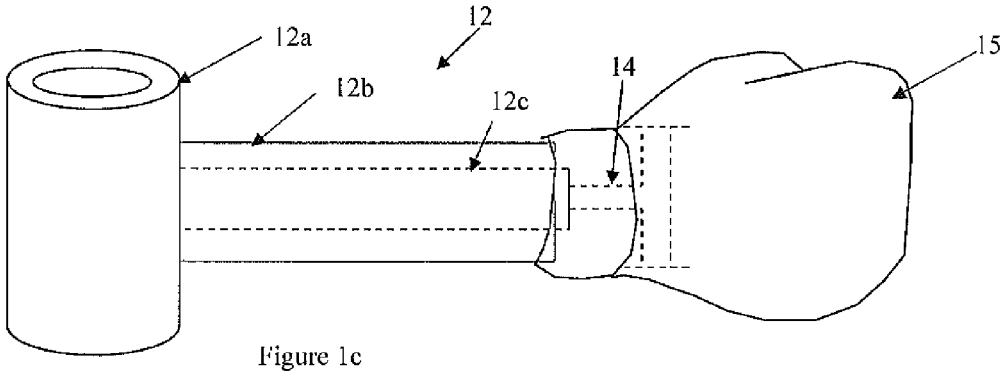
Figure 1D:
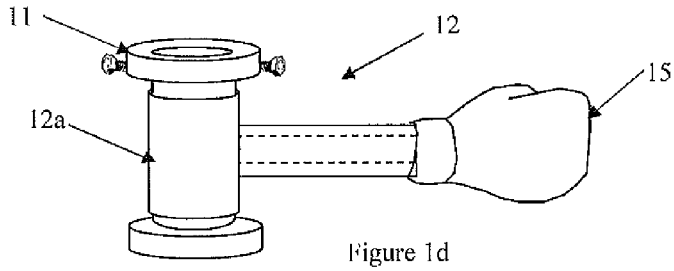
Figure 1E:
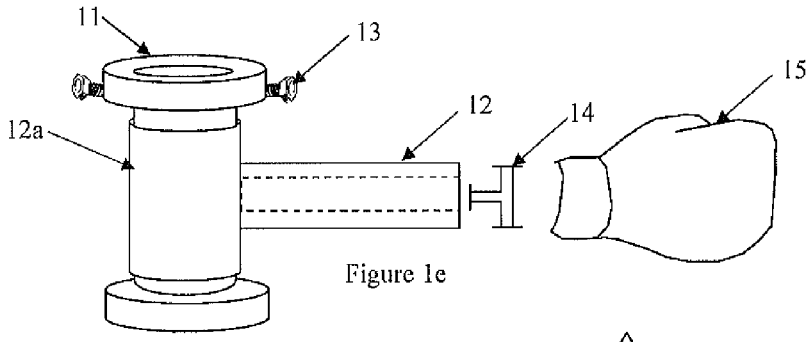
Figure 1F:
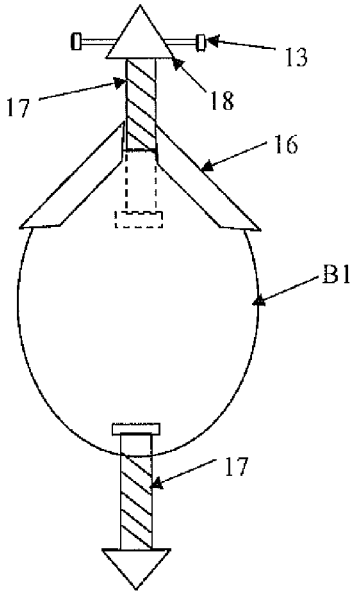
Figure 1G:
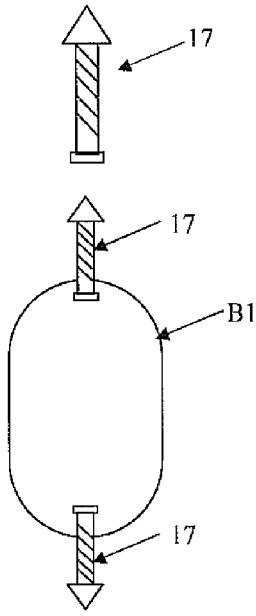
Figure 1H:
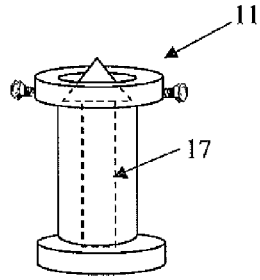
Figure 2B:
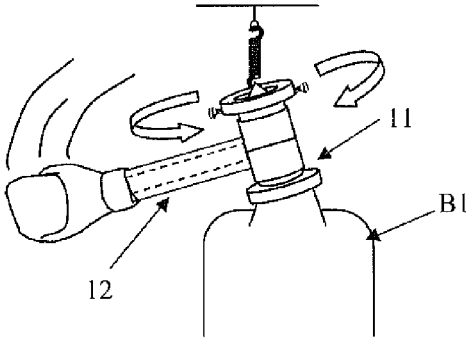
FIGS. 2*a*-2*b* are views of an embodiment of the invention using a heavy bag.
Figure 2A:
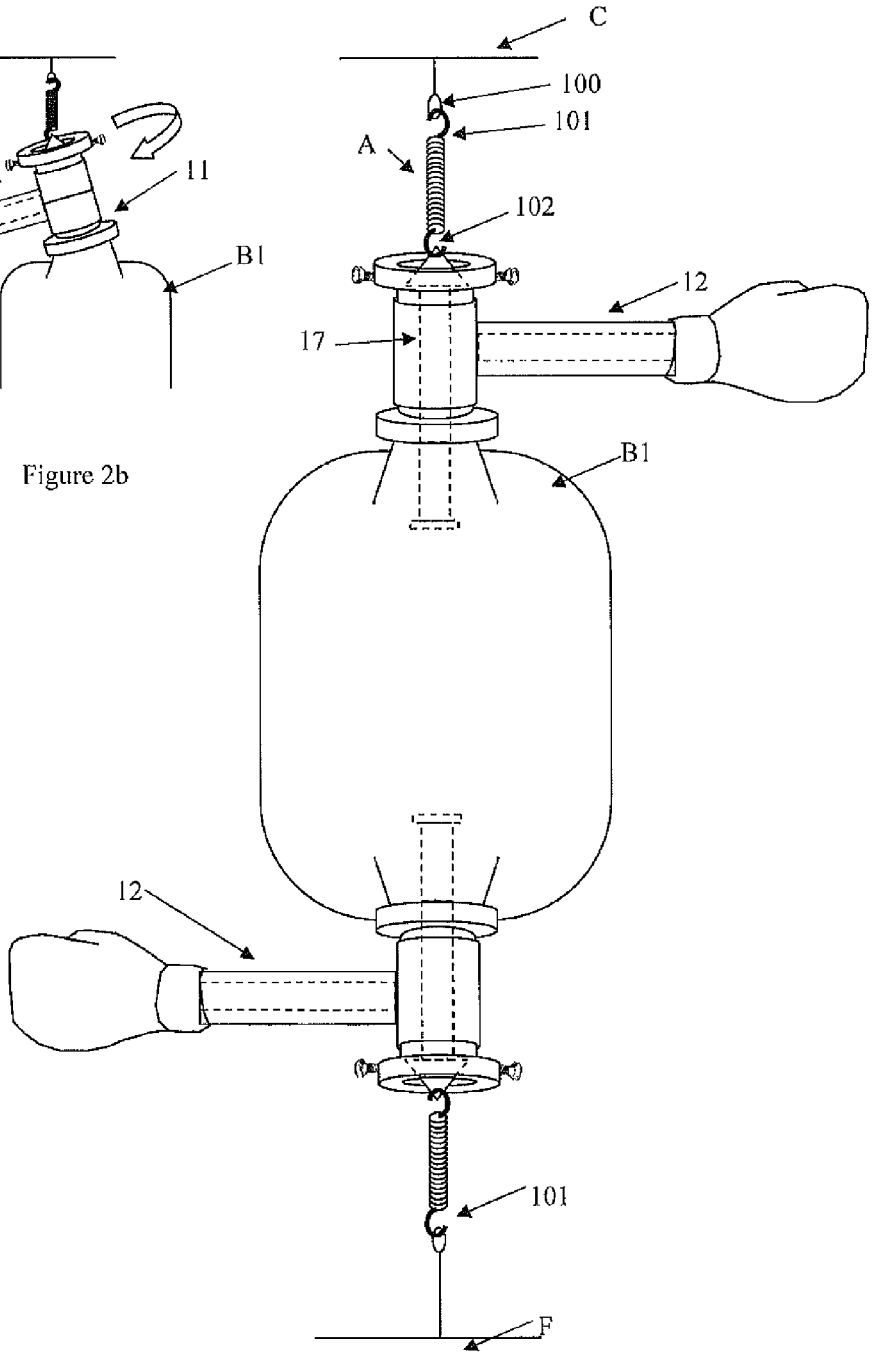
Figure 3B:
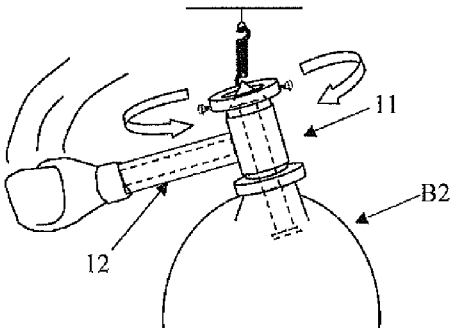
FIGS. 3*a*-3*b* are views of an embodiment of the invention using a small heavy bag.
Figure 3A:
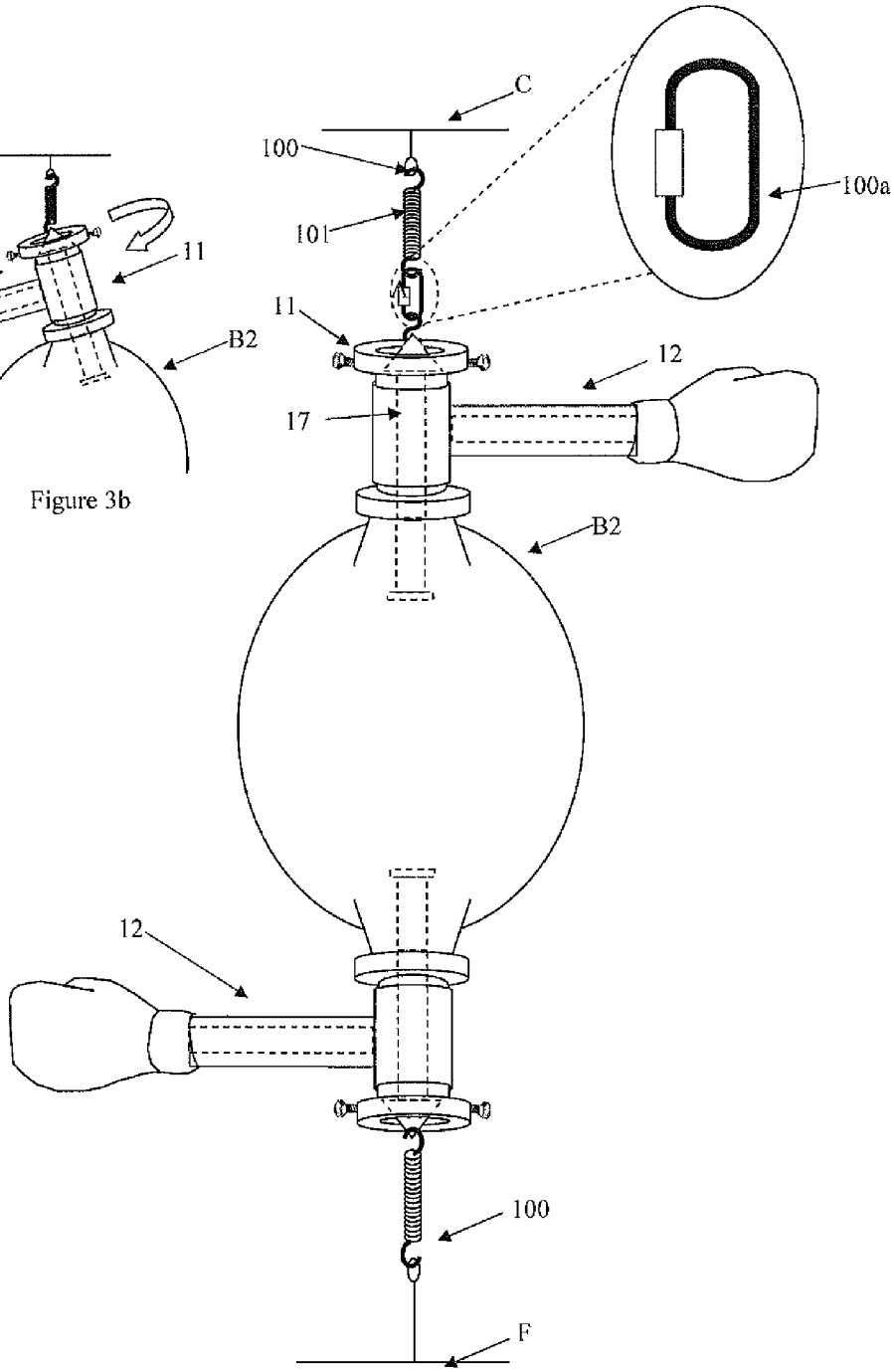

The present invention provides several embodiments of a boxing device for training the offensive and defensive movements for self-defense. FIGS. 1*a*-1*g* presents several element of the first invention's embodiment assembled, as shown in FIGS. 2*a*-2*b*, to provide a sparing partner or boxing device.

The boxing device constructed in accordance with the first embodiment of the present invention comprises a reel type piece 11 comprising two separated parts 11*a*, 11*b* assembled together that works as an axis holding the swinging boxing arm 12. The first portion 11*a* has an opening 11*c* wherein a hollow protrusion 11*d* extending from the second portion 11*b* is inserted. The reel piece 11 holds a metal rod 13 which holds an attachment A from the ceiling C or floor F such as a nylon or metal cable with attachments 100, springs 101 and hooks 102 in order to support the boxing device while training. The boxing arm 12 moves around the reel type 11 piece and comprises a hollowed base 12*a* linked to said reel piece 11 in such manner that the hollow base 12*a* substantially cover the outer surface of reel piece 11 separated portions 11*a*, 11*b*. Foam 12*b* is used to cover the rigid boxing arm extension 12*c* avoiding damages to the device user. The boxing arm extension 12*c* is provided with a T-type rod 14 that holds a boxing glove 15, as shown in FIG. 1*c* and FIG. 1*e*. A funnel type piece 16 made of thick aluminum metal or pvc material is placed over the double end bag bladder B1 or the heavy bag B2 in both superior and inferior portions; both funnels 16 are covered with leather and held in place with tight on strings; the funnel's small portion is inserted into the hollow inferior portion of the reel 11 and a plastic covered cable or nylon cable 17 runs through it and the reel 11. The cable is held in place by the metal rod 13 on top of the reel piece 11*a*. The metal rod is slide through a bore 13*b* at the reel 11. The end of the cable 17 has a metal double triangle 18 is usually attached or in combination with metal rod 13 is fixed to an attachment A which connects the boxing device with the ceiling C or floor F through a superior rubber cable or metal spring 100.

As shown in FIGS. 2*a*-2*b* and FIGS. 3*a*-3*b* similar piece or structure is used to hold the inferior reels rod and rubber cable. The funnel's 16 small portion is applied to the hollow inferior portion of the reel 11 and a plastic covered cable or nylon cable runs through it and the reel 11. The cable is held in place by the metal rod on top of the reel piece. The end of this cable has a metal double triangle to hold the metal rod and the superior rubber cable or metal spring. In both sides the union of the funnel piece 16 and the hollow reels 11 portion provides a rocking movement that lets the boxing arm 12 move in superior-inferior or inferior-superior motion. A bendy attachment A such as a spring gives flexible movement to the bag B1,B2. The boxing arms 12 moves unpredictably around the reel piece 11 without a specific pattern; however the funnel shape aids the rocking movement.

The embodiments can be combined with pressure sensors at the boxing arms gloves and/or to the specific areas of the double end bag B1 and heavy small bag B2 to count the punches that the trainee/user receives and the punches that he lands to give a simulation of a boxing match. The height of the double end bag B1 and small heavy bag B2 can be adjusted to any trainee by using longer or shorter rubber cables and by changing the amount of chain links and rubber cable respectively. Colored dots can be applied to different areas of the double end bag and small heavy bag to improve punch accuracy.

In practice the double end bag gives punch speed and the small heavy bag gives punch power. When the double end bag B1 and heavy bag B2 are hit by a punch or foot the energy produce by the impact initiates an antero-posterior or lateral movement. This movement causes a physical reaction in the boxing arm making a left-right-left horizontal rotational movement. The rocking funnel-reel movement allows a superior-inferior and inferior-superior rotational or straight movement of the boxing arm. The velocity and impact of the counter punch produce by the user impact depend directly of the user's energy impact.

An arrangement between the upper and inferior boxing arms 12 can be performed in order to simulate a superior jab punch and inferior lower body punch respectively. For example the upper arm may be two inches longer than the inferior boxing arm.

Figure 4:
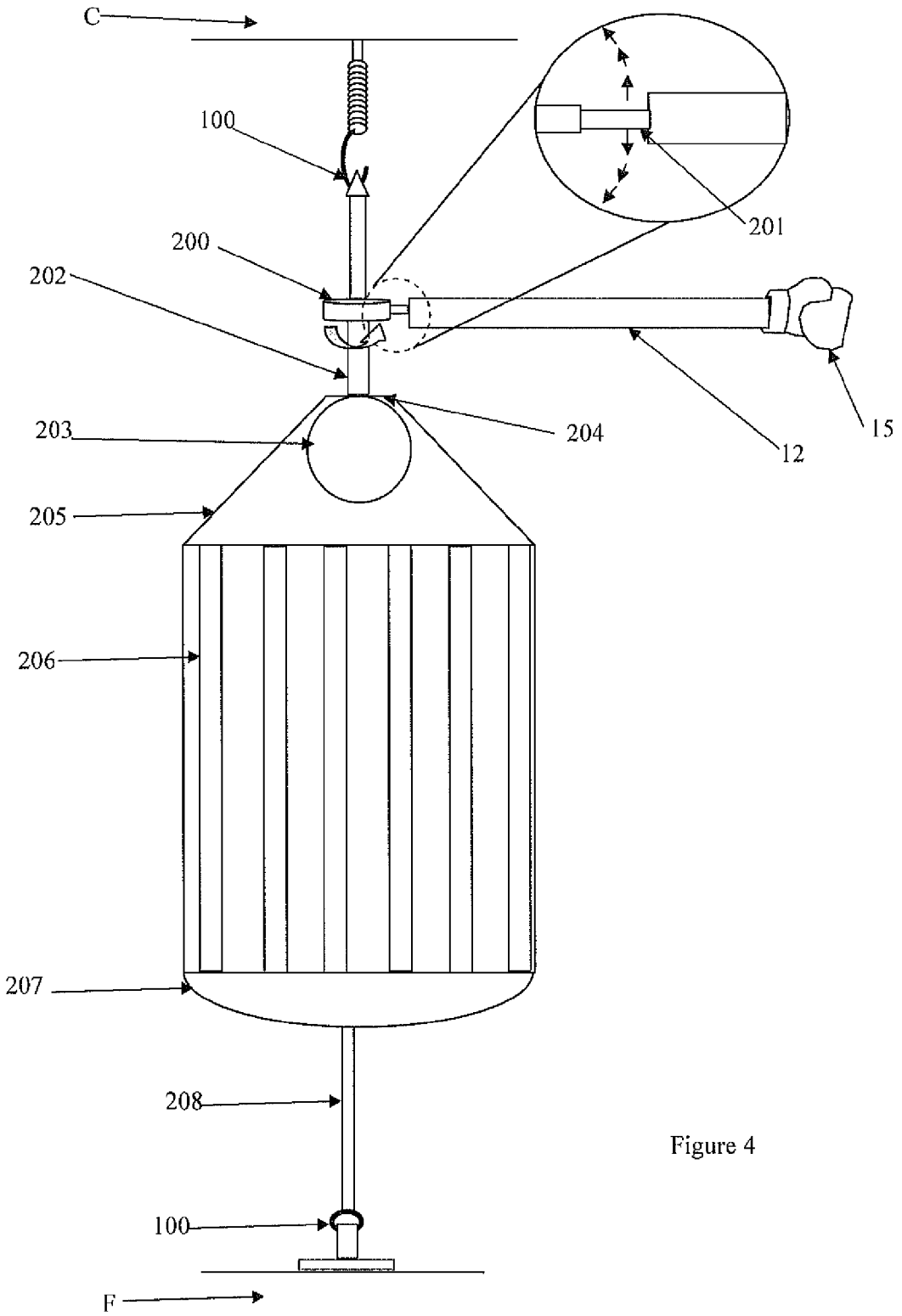
FIG. 4 is a view of an embodiment of the invention using a detachable bag.

Another embodiment of the present invention is a boxing device, substantially similar to the first device providing a sparing partner but has the advantage of a structure which is independent from the impact absorbing element or bag selected by the user. FIG. 4 discloses a boxing device using detachable bag. Similar to the first embodiment, this second embodiment is vertical connected to the ceiling C and Floor F using attachments A such as spring, hooks and cables and comprises a boxing arm body 12 connected to a ball bearing 200, wherein said ball bearing 200 is fixed to a pivot duct 202 that prevent the vertical displacement of the ball bearing 200 by having at least a different pipe size. A distal end of the duct 202 is connected, as mentioned before, to the attachment 100 and the other distal end is provided with a rocking movement assistant element 203 which is combined and substantially contained inside a funnel shaped portion 205. The funnel 205 bigger diameter portion or outsized portion is provided with holding elements, such as a bars 206, connected to a base 207 keeping a bag or any other element capable of withstand strikes between the funnel shaped portion 205, the bars 206 and base 207. The base 207 is connected to the floor using a cable 208 with attachments 100.

Figure 5:
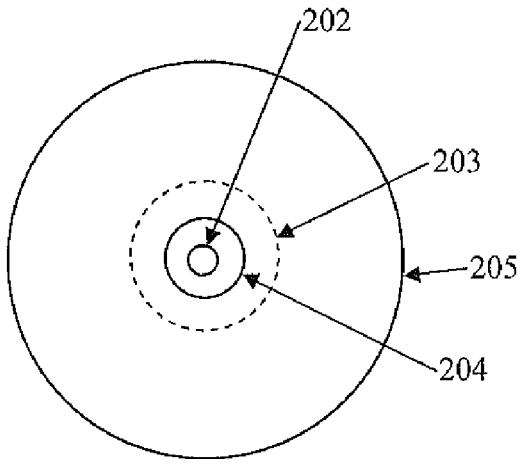
FIG. 5 is a top view of the bearing system for the second embodiment of the invention using a detachable bag.

FIG. 5 is a top view of the combination of the duct 202, the rocking movement assistant element 203 and the funnel shaped portion 205. The funnel smaller diameter portion rests substantially over the assistant element 203, however a space 204 is formed between the duct 202 holding the assistant element 203 and said funnel smaller diameter portion 205. Said space 204 between the duct 202 and the funnel provides a freely movement of the duct limit by the space 204 diameter allowing a superior-inferior and inferior-superior rotational or straight movement of the boxing arm body 12.

Figure 6:
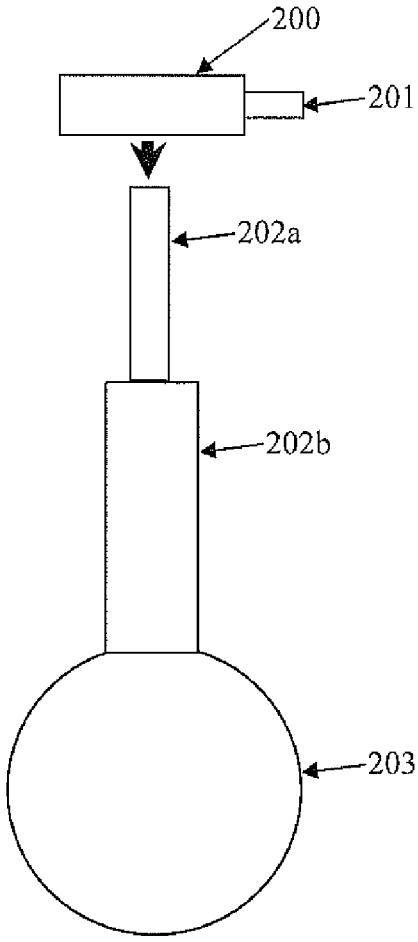
FIG. 6 is a view of the bearing system assembly of the invention using a detachable bag.
Figure 7:
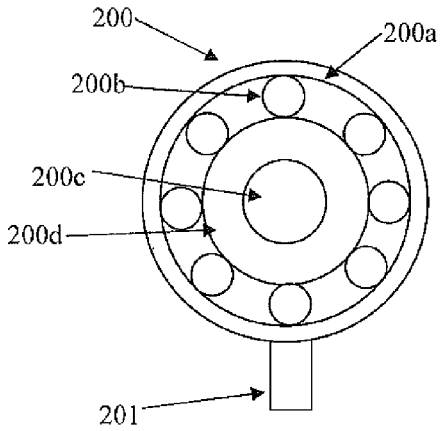
FIG. 7 is a top view of the ball bearing and boxing arm attachment for the invention.
Figure 8A:
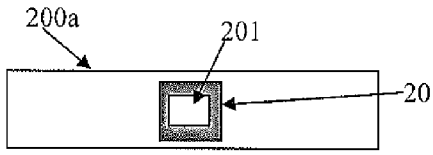
FIGS. 8*a*-8*c* are views of the arm attachment embodiment.
Figure 8B:
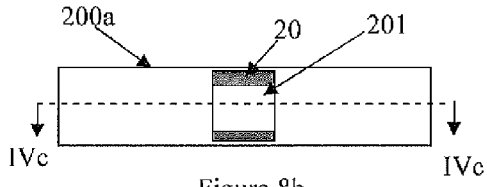
Figure 8C:
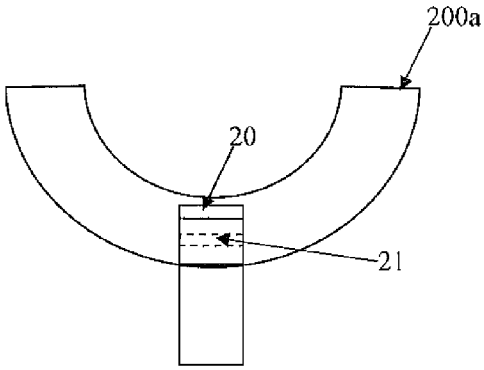
Figure 9:
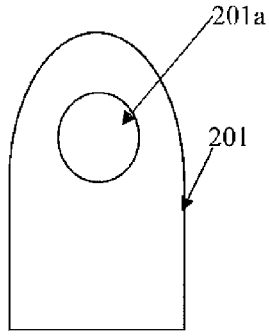
FIG. 9 is a view of the arm pivot of the invention.

FIG. 6 discloses the assembly of the ball bearing and the duct 202. As disclosed before, the duct 202 comprises different sizes 202*a*, 202*b* provided with a rocking movement assistant element 203 at a distal end. The ball bearing 200 is fixed in such way that a vertical displacement is prevented, for example by providing a duct 202 having at least two different diameters. Usually the ball bearing inner wall 200*d* is in close contact with the duct 202 which is slide through the ball bearing opening center 200*c*. The ball bearing 200 also comprises balls 200*b* for the rotational movement and an outer wall 200*a*. At the outer wall 200*a* an arm connection 201 is located in order to hold the boxing arm 12 in position. The boxing body is rigidly connected to the ball bearing 200 or with a vertical controlled displacement. The displacement of the arm connection 201 is limited by an elastic element 20 in close contact such as the rubber or springs. FIGS. 8*a*-8*c* show the arm connection 201 surrounded by the elastic 20. The arm connection 201 is fixed by a pivot pin 21 located at a hole 201*a* in the arm connection 201.

Figure 10:
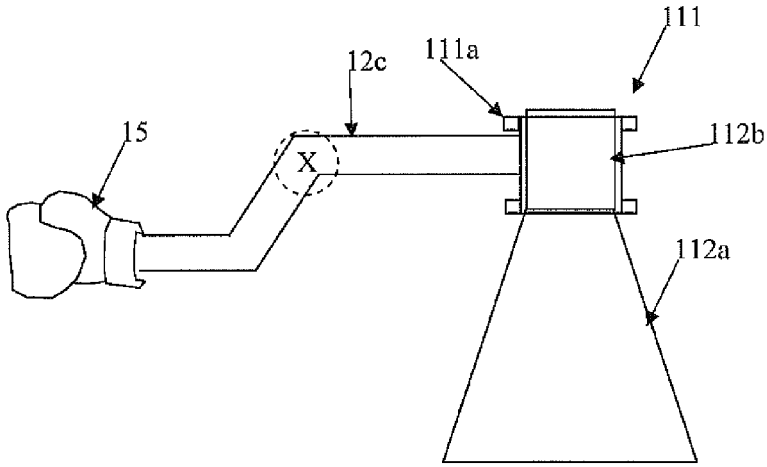
FIG. 10 is a view of a detachable arm assembly of the invention for any bag.
Figure 11:
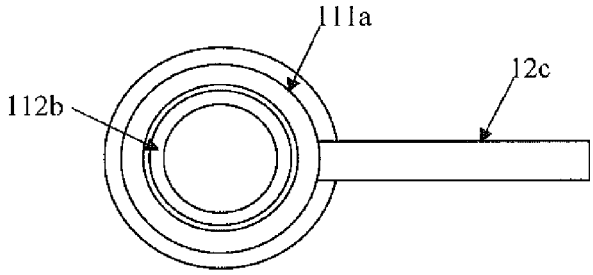
FIG. 11 is a top view of a detachable arm assembly of the invention for any bag.

FIG. 10 discloses a third embodiment of the present invention. The third embodiment is more directed to a removable sparring partner 111. The removable sparring partner comprises a hollow conical structure or funnel cover 112*a* with a cylindrical portion 112*b*, wherein said cylindrical portion 112*b* is substantially surrounded by an arm supported 111*a* as shown FIG. 11. A boxing arm 12 is connected to the arm supported 111*a* in such way that the arm supported 111*a* provides rotational movement for the boxing arm 12. For this embodiment the boxing arm extension 12*c*' is curved in order to provide a more real contact to the user. The boxing arm 12 can be a rigid body or it can be made of a more flexible configurations at the curved X allowing a superior-inferior and inferior-superior rotational or straight movement of the boxing arm 12 in combination with the bag movement.

Figure 12:
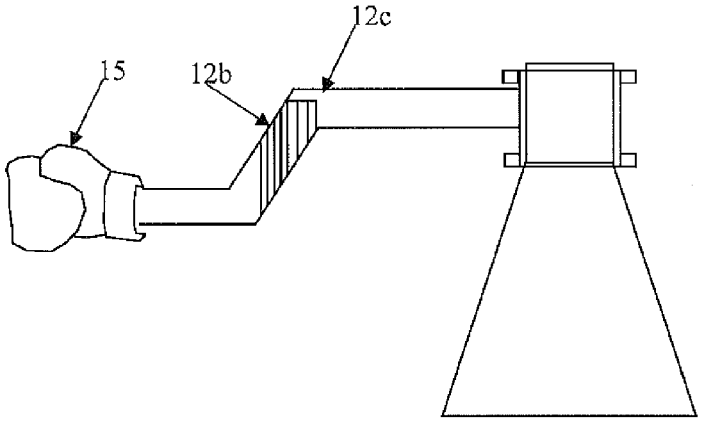
FIG. 12 is a view of a detachable arm assembly with arm movement.
Figure 13:
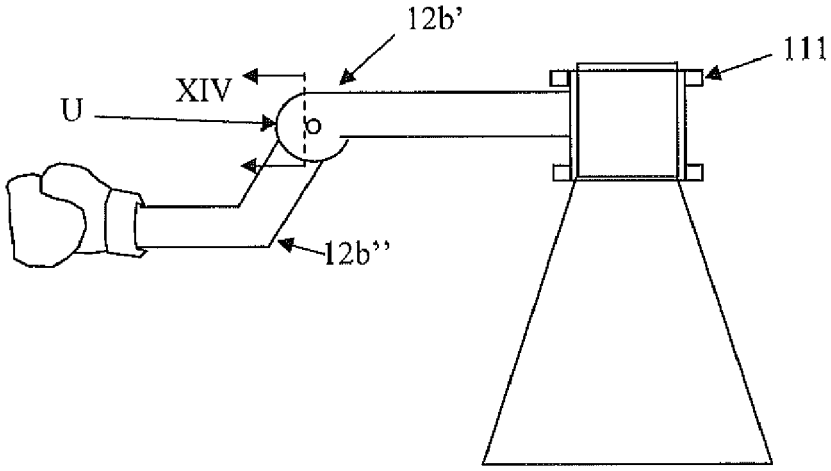
FIG. 13 is a view of a detachable arm assembly with arm movement.
Figure 14:
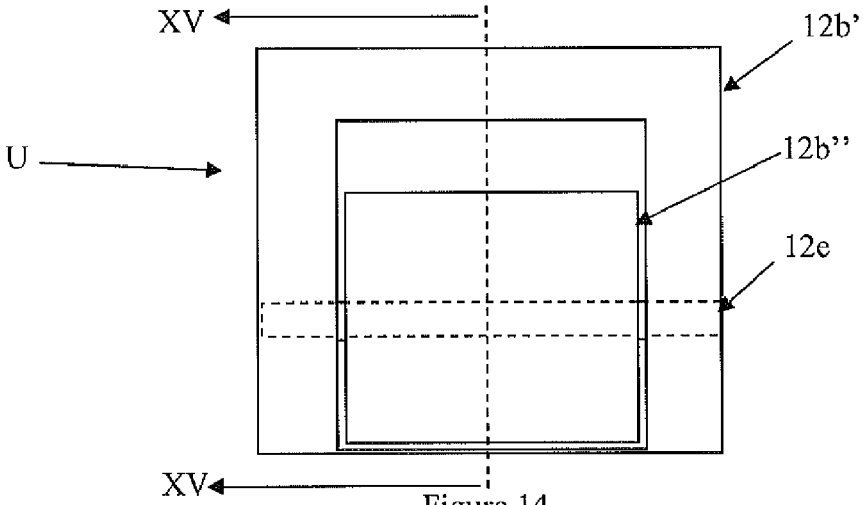
FIG. 14 is an exploded view of the detachable arm section II from FIG. 13.
Figure 15:
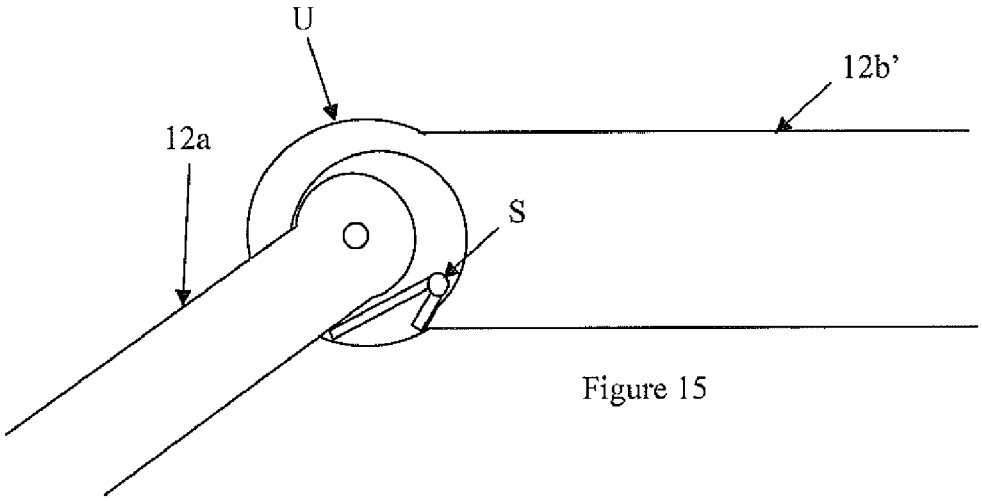
FIG. 15 is an exploded view of the detachable arm section III from FIG. 14.

FIGS. 12-15 disclose several configurations at the curved X. FIG. 12 discloses the first configuration 12*b* comprising different material or combination of multiple materials at the curved X allowing the arm to bend in a particular direction, more preferably vertically. Another configuration, as in FIGS. 13-15 comprises an boxing arm with two portions, wherein the first boxing arm portion 12*b*' is connected to a arm support 111 and to a second boxing arm portion 12*b*" by a move control unit U, wherein said second portion include the boxing glove and wherein said move control unit U comprises a pivot portion 12*e* supporting and holding the second boxing arm portion 12*b*" in combination with an elastic object, such as a spring S, controlling the vertical displacement of said second boxing arm 12*b*".

Several embodiment of the sparing partner or boxing device has been shown and described fulfilling all the objects and advantages sought therefor. The invention is not limited to the precise configuration described above. While the invention has been described as having a preferred design, it is understood that many changes, modifications, variations and other uses and applications of the subject invention will, however, become apparent to those skilled in the art without materially departing from the novel teachings and advantages of this invention after considering this specification together with the accompanying drawings. Accordingly, all such changes, modifications, variations and other uses and applications which do not depart from the spirit and scope of the invention are deemed to be covered by this invention as defined in the following claims and their legal equivalents. In the claims, means-plus-function clauses, if any, are intended to cover the structures described herein as performing the recited function and not only structural equivalents but also equivalent structures.

All of the patents, patent applications, and publications recited herein, and in the Declaration attached hereto, if any, are hereby incorporated by reference as if set forth in their entirety herein. All, or substantially all, the components disclosed in such patents may be used in the embodiments of the present invention, as well as equivalents thereof. The details in the patents, patent applications, and publications incorporated by reference herein may be considered to be incorporable at applicant's option, into the claims during prosecution as further limitations in the claims to patentably distinguish any amended claims from any applied prior art.

What is claimed is:

1. A boxing device that fight backs, comprising:

an impact absorbing element, a substantially fixed impact absorbing element supporting structure comprising ceiling attachments and floor attachments physically connecting the impact absorbing element to the ceiling and the floor;

a padded boxing arm having a first and second distal ends, wherein said boxing arm comprises a boxing arm body, a boxing glove at the boxing arm's first distal end and a ball bearing at a boxing arm's second distal end, a pivot duct comprising a tubular body with two distal ends, wherein said pivot duct comprises different dimensions preventing the vertical displacement of the ball bearing, wherein said duct's first distal end is connected to the ceiling attachments and the duct's second distal end has a rocking movement assistant element, a funnel shaped outsized portion comprising holding elements, a base, wherein said base is connected to said holding elements and to the floor attachments, and wherein said assistant element is positioned inside said funnel shaped portion assisting the rocking movement of the boxing arm.

2. The boxing device of claim 1, wherein said funnel shaped portion substantially rests over the assistant element and around the tubular body with a space between said tubular body and said funnel portion.

3. The boxing device of claim 1, wherein said ball bearing comprises elastic elements to control the boxing body arm movement.

4. The boxing device of claim 1, wherein said padded arm and said impact absorbing element further comprise pressure sensors on the padded arm's glove and on specific areas of the impact absorbing element to count the punches that a trainee receives or lands to give the simulation of a boxing match.

5. The boxing device of claim 1, wherein said holding elements are distributed around the funnel's outsized portion, surrounds the impact absorbing element and retains said absorbing impact element on top of the base.

* * * * *